US009725840B2

(12) United States Patent
Choi et al.

(10) Patent No.: US 9,725,840 B2
(45) Date of Patent: Aug. 8, 2017

(54) DRIVING APPARATUS FOR WASHING MACHINE AND WASHING MACHINE HAVING THE SAME

(75) Inventors: Myung Gui Choi, Suwon-si (KR); Woon Yong Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1359 days.

(21) Appl. No.: 13/570,594

(22) Filed: Aug. 9, 2012

(65) Prior Publication Data

US 2013/0036773 A1 Feb. 14, 2013

(30) Foreign Application Priority Data

Aug. 12, 2011 (KR) ..... 10-2011-0080586

(51) Int. Cl.

| | |
|---|---|
| ***D06F 23/00*** | (2006.01) |
| ***D06F 37/40*** | (2006.01) |
| ***D06F 23/04*** | (2006.01) |
| ***D06F 37/20*** | (2006.01) |
| ***D06F 37/30*** | (2006.01) |

(52) U.S. Cl.

CPC ..... *D06F 37/40* (2013.01); *D06F 23/04* (2013.01); *D06F 37/206* (2013.01); *D06F 37/304* (2013.01)

(58) Field of Classification Search

CPC ..... D06F 37/40; D06F 37/304; D06F 37/206; D06F 23/04

See application file for complete search history.

(56) References Cited

U.S. PATENT DOCUMENTS

2005/0223754 A1* 10/2005 Choi ..... D06F 37/40 68/3 R
2007/0132323 A1* 6/2007 Park ..... H02K 1/30 310/67 R (Continued)

FOREIGN PATENT DOCUMENTS

CN 1566482 1/2005
CN 1771363 5/2006

(Continued)

OTHER PUBLICATIONS

Chinese Office Action dated Sep. 2, 2015 in corresponding Chinese Patent Application No. 201210286789.2, 13 pages.

(Continued)

*Primary Examiner* — Michael Barr
*Assistant Examiner* — Benjamin L Osterhout
(74) *Attorney, Agent, or Firm* — Staas & Halsey LLP

(57) ABSTRACT

A washing machine driving apparatus and a washing machine having the same, capable of minimizing the coupling structure of a clutch and a motor and including a stator provided in a shape of a ring, a rotor disposed around the stator and rotating by electromagnetic interaction with the stator, and a clutch configured to transmit a rotary force of the rotor selectively to the rotating tub and the pulsator, wherein the stator comprises a stator core, an upper insulator covering an upper portion of the stator core and a lower insulator covering a lower portion of the stator core, and wherein the upper insulator has a mounting part protruding upward from an upper side of the upper insulator such that the clutch is coupled to the upper insulator.

14 Claims, 7 Drawing Sheets

(56) References Cited

U.S. PATENT DOCUMENTS

| | | | | |
|---|---|---|---|---|
| 2007/0152521 | A1* | 7/2007 | Park | D06F 37/304 310/67 R |
| 2008/0042510 | A1* | 2/2008 | Park | D06F 37/304 310/216.004 |
| 2008/0122300 | A1* | 5/2008 | Cho | H02K 1/148 310/43 |

FOREIGN PATENT DOCUMENTS

| | | |
|---|---|---|
| CN | 101496257 | 7/2009 |
| JP | 9-10474 | 1/1997 |
| KR | 10-2004-0036192 | 4/2004 |
| KR | 10-2008-0092023 | 10/2008 |
| KR | 10-2006-0085412 | 7/2009 |
| KR | 10-2010-0111435 | 10/2010 |

OTHER PUBLICATIONS

Notification of Granting of Patent Right to Invention, dated Jul. 6, 2016, in corresponding Chinese Application No. 201210286789.2 (8 pp.).

Korean Office Action dated May 16, 2017, in corresponding Korean Patent Application No. 10-2011-0080586.

* cited by examiner

DRIVING APPARATUS FOR WASHING MACHINE AND WASHING MACHINE HAVING THE SAME

CROSS-REFERENCE TO RELATED APPLICATIONS

This application claims priority to Korean Patent Applications No. 10-2011-0080586, filed on Aug. 12, 2011 in the Korean Intellectual Property Office, the disclosure of which is incorporated herein by reference.

BACKGROUND

1. Field

Embodiments of the present disclosure relate to a washing machine, and more particularly, to a driving apparatus for selectively rotating a rotating tub and a pulsator in a washing machine.

2. Description of the Related Art

A washing machine is a machine configured to wash laundry by use of electric power, in general, includes a tub to accommodate a washing water; a rotating tub rotatably installed inside the tub; a pulsator rotatably installed at the bottom of the rotating tub; and a motor and a clutch that are configured to rotate the rotating tub and the pulsator.

As the rotating tub and the pulsator rotate in a state that laundry and washing water are input in the rotating tub, the pulsator stirs the laundry together with washing water, thereby removing dirt from the laundry.

The clutch installed on the washing machine is connected to the rotating tub and to the pulsator such that electric power generated from the motor is selectively transmitted to the rotating tub and to the pulsator.

A mechanical clutch is disposed on the center of a shaft and a motor is disposed at one side of a shaft, and the clutch is connected to the motor a belt to drive a washing machine. However, such a configuration has a difficulty in implementing the center of gravity. Different from such a configuration-, if the motor is directly connected to the shaft, the speed and the rotary force are not precisely controlled with only using the motor.

SUMMARY

Therefore, it is an aspect of the present disclosure to provide a washing machine driving apparatus and a washing machine having the same, capable of minimizing the coupling structure of a clutch and a motor.

It is another aspect to provide a washing machine driving apparatus and a washing machine having the same, in which a stator divided into many parts is used and thus the productivity in manufacturing the stator is improved.

It is another aspect to provide a washing machine driving apparatus and a washing machine having the same, capable of preventing moisture from infiltrating into a hall sensor assembly.

Additional aspects will be set forth in part in the description which follows and, in part, will be obvious from the description, or may be learned by practice of the disclosure.

In accordance with one aspect, a driving apparatus for a washing machine a rotating tub to accommodate laundry and a pulsator rotatably installed at a lower portion of the rotating tub to generate a stream of water and move the laundry, includes a stator, a rotor and a clutch. The stator is provided in a shape of a ring. The rotor is disposed around the stator and rotating by electromagnetic interaction with the stator. The clutch is configured to transmit a rotary force of the rotor selectively to the rotating tub and the pulsator. The stator includes a stator core, an upper insulator covering an upper portion of the stator core and a lower insulator covering a lower portion of the stator core. The upper insulator has a mounting part protruding upward from an upper side of the upper insulator such that the clutch is coupled to the upper insulator.

The mounting part protrudes upward from the upper side of the upper insulator and includes a plurality of support ribs that are arranged along a circumferential direction of the upper insulator such that the plurality of support ribs is coupled to the clutch.

The clutch includes a clutch body forming an external appearance of the clutch, and a transfer gear provided at a lower portion of the clutch body to selectively transmit a rotary force to the rotating tub, wherein the mounting part further includes an opening that is formed at an inner side of the plurality of support ribs in a radial direction of the upper insulator such that the transfer gear passes through the upper insulator and then is disposed inside the stator.

If the clutch is coupled to the support ribs, a part of the clutch body is disposed inside the stator by passing through the opening.

The plurality of support ribs are spaced apart from one another to form a through-hole part among the plurality of support ribs, and the clutch further includes a clutch lever configured to control a rotation of the transfer gear while engaging and disengaging with the transfer gear, and wherein the clutch level extends from outside to inside of the stator by passing through the through-hole part.

The mounting part includes a mounting surface that connects upper surfaces of the plurality of support ribs to one another in a shape of a ring such that the clutch is mounted on the mounting surface.

The mounting part further includes a position-determining protrusion formed on the mounting surface such that the clutch is coupled to a precise position of the mounting surface.

Each of the plurality of support ribs includes a first coupling hole formed inside of the each support rib, the lower insulator includes a plurality of protruding ribs that protrude to an inner side of the lower insulator along a circumferential direction of the lower insulator and are disposed at positions corresponding to the respective support ribs, and each of the plurality of protruding ribs includes a second coupling hole allowing a coupling member to pass therethrough. If the upper insulator is coupled to the lower insulator, the first coupling hole forms a coupling hole in cooperation with the second coupling hole as the plurality of support ribs are coupled to the plurality of protruding ribs, respectively.

The upper insulator is provided at one side of an upper surface thereof with a connection part to which the hall sensor assembly is connected.

The driving apparatus further includes a hall sensor assembly which is coupled to the upper side of the upper insulator and is configured to supply a motor with power and to sense a magnet provided on the rotor.

An upper surface of the hall sensor assembly includes a slanting surface that lowers with a slope in an outward radial direction of the stator such that water flows on the upper surface of the hall sensor assembly.

The hall sensor assembly includes a sensor and a power connector that protrude from the slanting surface, wherein a passage is formed between the sensor and the power connector such that water flows through the passage in an outward radial direction of the stator.

The upper insulator is provided at the upper surface thereof with a connection part to which the hall sensor assembly is connected, and wherein the hall sensor assembly completely covers the connection part to prevent moisture from being infiltrated to the connection part.

In accordance with another aspect, a washing machine includes a rotating tub, a pulsator, a stator, a rotor and a clutch. The rotating tub is configured to accommodate laundry. The pulsator is disposed inside the rotating tub. The stator is disposed at a lower portion of the rotating tub. The rotor is disposed to make an electromagnetic interaction with the stator. The clutch is configured to transmit a rotary force of the rotor selectively to the rotating tub and the pulsator. The clutch includes a clutch body and a transfer gear disposed at a lower portion of the clutch body. The stator includes a stator core, a lower insulator covering a lower portion of the stator core and an upper insulator covering an upper portion of the stator core. The upper insulator includes a plurality of support ribs and an opening. The support ribs are arranged along a circumferential direction of the stator and coupled to the clutch body. The opening allows the transfer gear to pass therethrough when the stator is coupled to the clutch.

The plurality of support ribs protrudes upward from an upper side of the upper insulator.

The plurality of support ribs are spaced apart from one another, and wherein the clutch further includes a clutch lever that extends to be adjacent to the transfer gear by passing through between the support ribs.

The washing machine further includes a hall sensor assembly coupled to an upper portion of the stator and including a upper surface having a slanting surface that lowers with a slope in an outward radial direction of the stator such that water flows in an opposite direction of a central shaft of the clutch.

In accordance with another aspect, a washing machine comprising, a rotating tub configured to accommodate laundry; a pulsator disposed inside the rotating tub, a driving unit comprising, a stator disposed at a lower portion of the rotating tub, a rotor disposed to make an electromagnetic interaction with the stator; and a clutch, which is configured to transmit a rotary force of the rotor selectively to the rotating tub and the pulsator and comprises a clutch body and a transfer gear disposed at a lower portion of the clutch body, a hall sensor assembly coupled to the upper side of the stator and is configured to supply a driving unit with power and to sense a magnet provided on the rotor.

As described above, according to the embodiment of the present disclosure, a driving apparatus for a washing machine is reduced in size by coupling a clutch to a motor such that a transfer gear of the clutch is disposed inside a stator.

Since a stator includes a stator core, an upper insulator and a lower insulator, the assembly of the stator is simplified and thus the cost required for assembling the stator is reduced.

Since an upper surface of a hall sensor assembly is slanted, moisture is not gathered or infiltrated in the hall sensor assembly.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
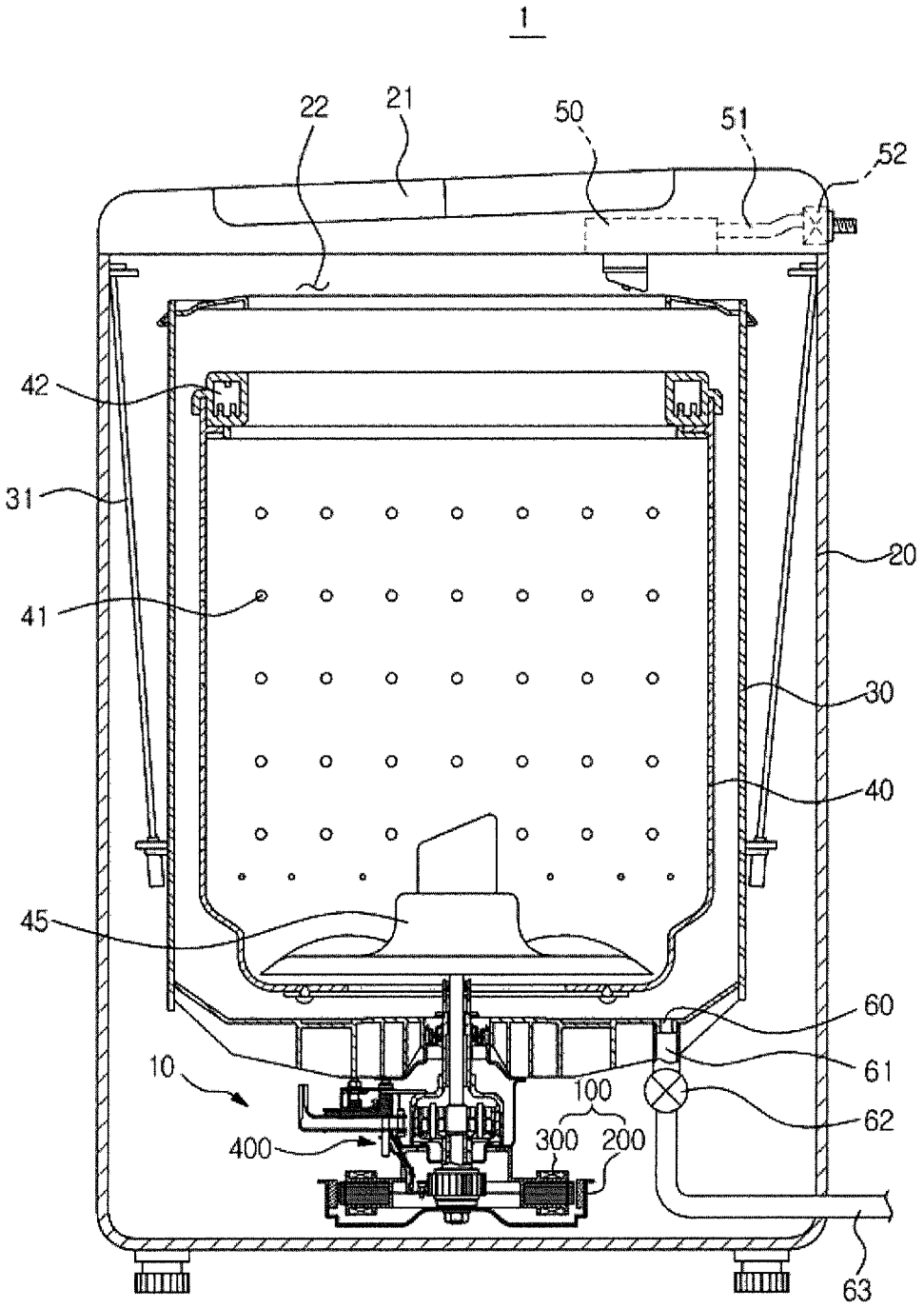
FIG. 1 is a cross-sectional view illustrating a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view illustrating a washing machine according to an embodiment of the present disclosure.

Referring to FIG. 1, a washing machine 1 includes a cabinet 20 forming an external appearance of the washing machine 1; a tub 30 disposed inside the cabinet 20 to accommodate a washing water; a rotating tub 40 rotatably disposed inside the tub 30; and a pulsator 45 disposed inside the tub 40 to generate a stream of water.

An insert opening 22 is formed at an upper portion of the cabinet 20 such that laundry is inserted to the inside the rotating tub 40. The insert opening 22 is open and closed by a door 21 installed at the upper portion of the cabinet 20.

The tub 30 is hung on the cabinet 20 while being supported by a suspension apparatus 31 that connects a lower side of an outer surface of the tub 30 to an upper side of an inner surface of the cabinet 20. The suspension apparatus 30 reduces vibration that is generated from the cabinet 20 or the tub 30 during a washing cycle or a spinning cycle.

A water-supply pipe 51 is installed at the upper portion of the tub 30 to supply a washing water. One side of the water-supply pipe 51 is connected to an external water-supply source (not shown), and the other side of the water-supply pipe 51 is connected to a detergent-dispensing apparatus 50. The water supplied through the water-supply pipe 51 passes through the detergent dispensing apparatus 50 and then supplied to the inside the tub 30 together with detergent. A water-supply valve 52 is installed on the water-supply pipe 50 to control the supply of water.

The rotating tub 40 is provided in the shape of a cylinder having an open upper portion. A plurality of spinning holes 41 are formed on a lateral surface of the rotating tub 40 such that the inner space of the rotating tub 40 communicates with the inner space of the tub 30.

A balancer 42 may be installed at the upper portion of the rotating tub 40 to compensate for a load imbalance occurring in the rotating tub 40 during a high-speed rotation of the rotating tub 40, so that the rotating tub 40 stably rotates.

The pulsator 45 generates a stream of water while rotating forward and backward, and the laundry is stirred together with the washing water by the stream of water.

A drain hole 60 is formed through a bottom of the tub 30 to discharge the washing water that is kept in the tub 30. A first drain pipe 61 is connected to the drain hole 60. A drain valve 62 is installed on the first drain pipe 61 to control the draining.

An exit of the drain valve 62 is connected to a second drain pipe 63 that is configured to discharge the washing water to outside. The drain valve 62 may include a solenoid device or a link device connected to an electric motor.

A driving apparatus 10 for the washing machine 1 includes a motor 100 which generates a driving force by receiving a power, a driving shaft 500 configured to transmit a rotary force generated from the motor 100 to the rotating tub 40 and the pulsator 45, and a clutch 400 configured to simultaneously or selectively rotate the pulsator 45 and the rotating tub 40 by controlling the rotation of the driving shaft 500.

In particular, the motor 100, the clutch 400 and the driving shaft 500 are coupled in a tandem structure where the motor 100, the clutch 400, and the driving shaft 500 are lined up one behind another. Accordingly, the rotation speed and rotary force of the rotating tub 40 is primarily controlled by the clutch 400 and then secondarily controlled by the motor 100 such that the rotating tub 40 is precisely controlled.

Further, when the rotating tub 40 needs to stop rotating after the completion of a spinning cycle, the rotation of the rotating tub 40 is stopped by a break band (not shown) inside the clutch 400 and a short break (not shown) of the motor 100, thereby shortening the time required for breaking and reducing the vibration generated at a breaking event.

The driving shaft 500 includes a spinning shaft 520, which is provided in a hollow type and is configured to transmit a rotary force to the rotating tub 40, and a washing shaft 510, which is configured to rotate the pulsator 45 and installed inside the hollowness of the spinning shaft 520.

Hereinafter, a driving apparatus for a washing machine according to an embodiment of the present disclosure is described.

Figure 2:
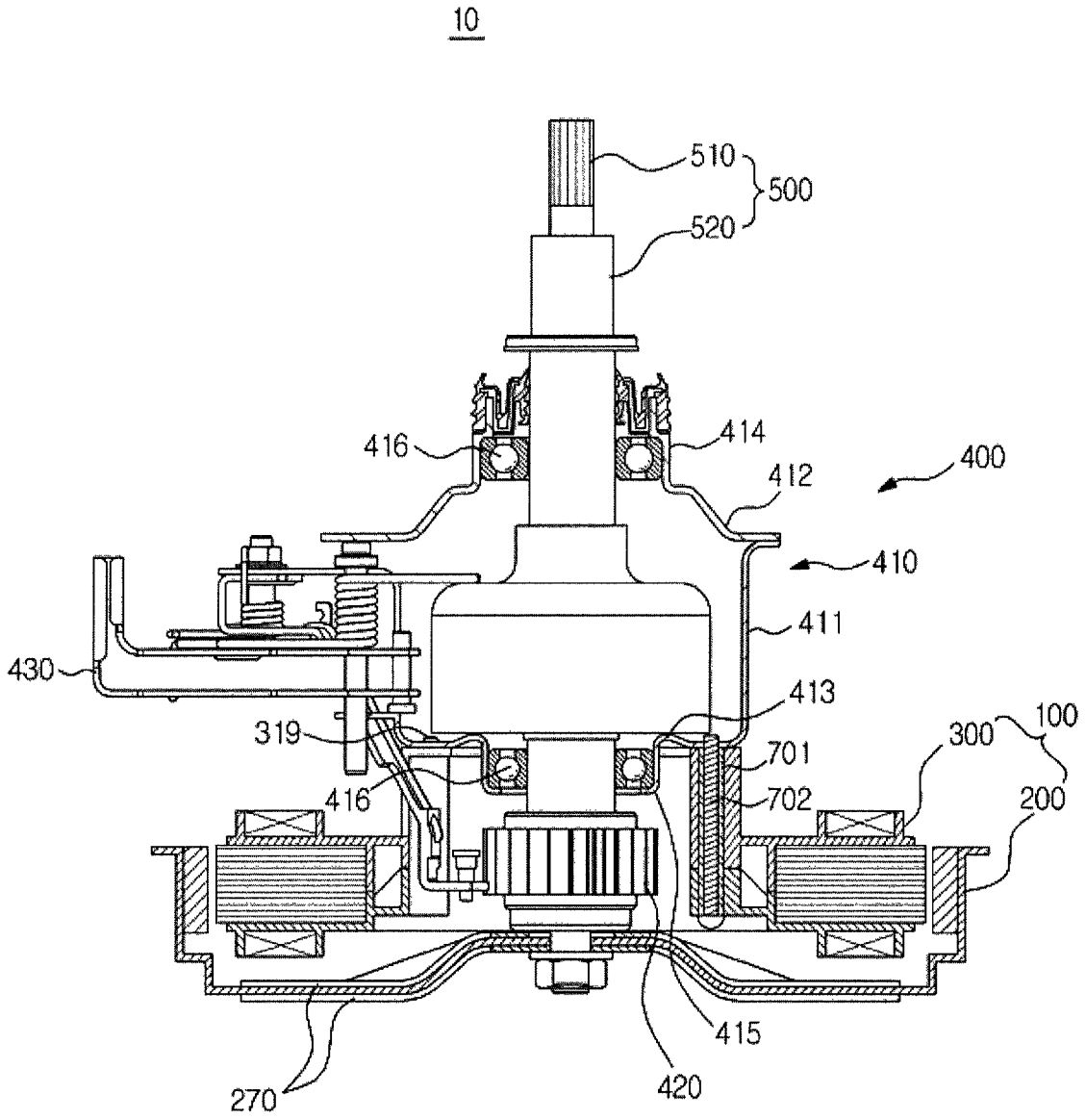
FIG. 2 is a view illustrating a driving apparatus for the washing machine according to the embodiment of the present disclosure.
Figure 3:
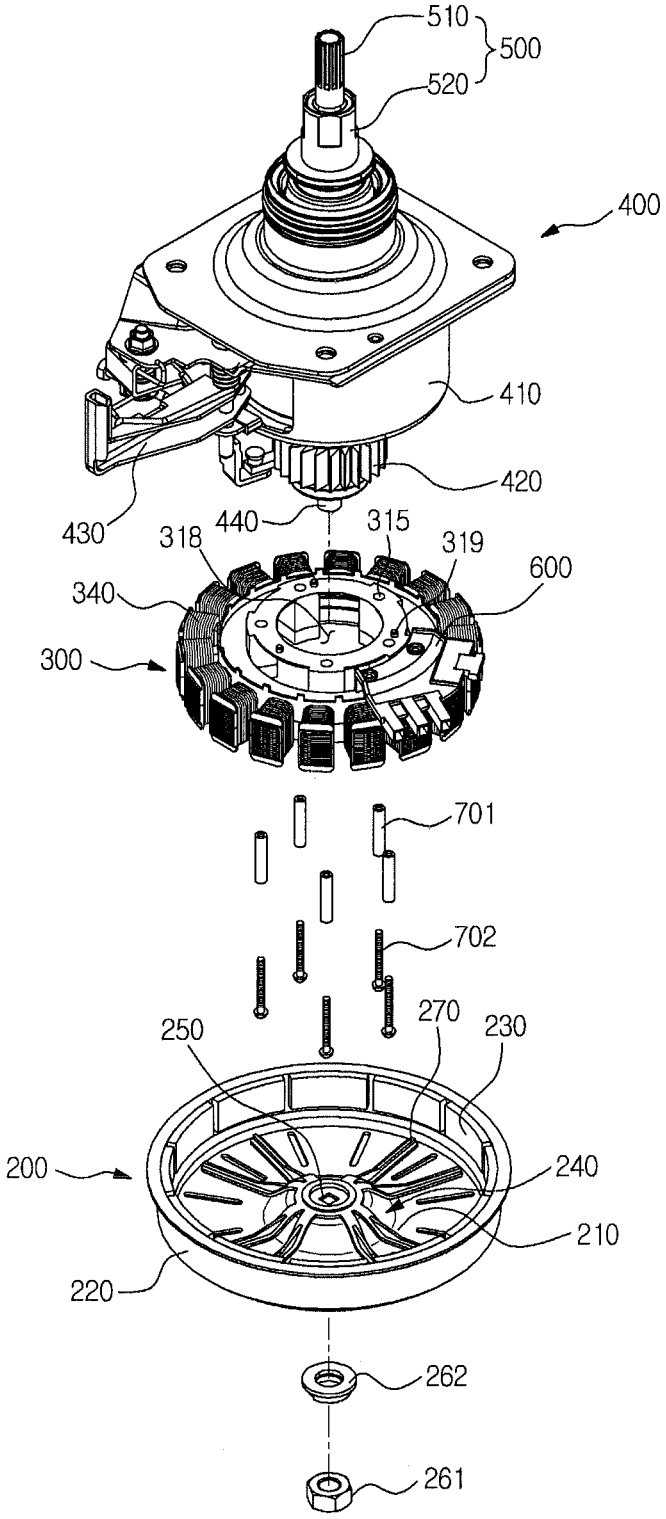
FIG. 3 is a perspective view illustrating the configuration of the driving apparatus of the washing machine of the FIG. 2.

FIG. 2 is a view illustrating a driving apparatus for the washing machine according to the embodiment of the present disclosure. FIG. 3 is a perspective view illustrating the configuration of the driving apparatus of the washing machine of the FIG. 2

Referring to FIGS. 2 and 3, the driving apparatus 10 includes the motor 100 generating a driving force, the driving shaft 500 transmitting a rotary force, which is generated from the motor 100, to the rotating tub 40 and the pulsator 45, and the clutch 400 which simultaneously or selectively transmits a rotary force from the driving shaft 500 to the pulsator 45 and to the rotating tub 40.

As described above, the driving shaft 500 includes the spinning shaft 520 transmitting a rotary force to the rotating tub 40 and the washing shaft 510 rotating the pulsator 45.

The motor 100 is implemented using a Brushless DC (BLDC) motor that can control the rotation speed at different levels. The motor 100 includes a stator 300 and a rotor 200, which is disposed around the stator 300 and rotates through an electromagnetic interaction with the stator 300.

A hall sensor assembly 600 is connected onto one side of an upper surface of the stator 300. The hall sensor assembly 600 is configured to supply the motor 100 with a power and to control the rotation of the rotor 200 by detecting the position of a magnet 230 that is attached to the rotor 200. The configuration of the hall sensor assembly will be described with reference to FIGS. 5 to 7.

A coil 340 is wound around a plurality of projections that protrudes in an outward radial direction of the stator 300. The coupling structure of the stator 300 will be described with reference to FIG. 4.

The rotor 200 includes a bottom surface 210 and a side wall 220 extending from a rim of the bottom surface 210. A plurality of magnets 230 are coupled to an inner surface of the side wall 220 such that the rotor 200 rotates by electromagnetically interacting with the coil 340 of the stator 300.

A protrusion 240 protrudes from a center portion of the bottom surface 210.

The protrusion 240 is integrally formed with the bottom surface 210. Alternatively, the protrusion 240 may be formed using additional reinforcing member and then coupled to the bottom surface 210.

A coupling hole 250 is formed in the middle of the protrusion 240 such that a rotary shaft 440 of the clutch 400 is coupled to the rotor 200 by a coupling member. Referring to FIG. 3, the rotary shaft 440 is coupled to the rotor 200 by a nut 261.

Injection molding is performed to form an injection molded material 270 on the bottom surface 210 such that the protrusion 240 is completely covered.

The washing shaft 510 has one end, which is coupled to the rotor 200 passes through the hollowness of the spinning shaft 520 and the other end connected to the pulsator (reference numeral 45 in FIG. 1).

The clutch 400 includes a clutch body 410, a transfer gear 420, the rotary shaft 440, and a clutch lever 430. The clutch body 410 forms an external appearance of the clutch 400. The transfer gear 420 is disposed at a lower portion of the clutch body 410. The rotary shaft 440 extends from the clutch body 410 to a lower side of the transfer gear 420, and rotates together with the rotor 200 with one end coupled to the rotor 200. The clutch lever 430 selectively rotates the spinning shaft 520 while engaging and disengaging with the transfer gear 420.

The clutch body 410 includes a cylindrical body part 411, an upper plate 412 covering an upper portion of the cylindrical body part 411, and a lower plate 413 covering a lower portion of the cylindrical body part 411.

The driving shaft 500, which extends toward the tub 30, is disposed in the center of the upper plate 412. An upper protrusion 414 bentedly protrudes from the upper plate 412 toward the tub 30 while surrounding the driving shaft 500.

The rotary shaft 440, which extends toward the motor 100, is disposed in the center of the lower plate 413. A lower protrusion 415 bentedly protrudes from the lower plate 413 toward the motor 100 while surrounding the rotary shaft 440.

Bearings 416 are provided between the upper protrusion 414 and the driving shaft 500, and between the lower protrusion 415 and the rotary shaft 440, respectively, such that the driving shaft 500 and the rotary shaft 400 smoothly rotate.

The clutch 400 is supported such that the clutch body 410 is coupled to the upper portion of the stator 300 through a coupling member. The coupling of the clutch 400 to the stator 300 will be described with reference to FIG. 4.

The clutch lever 430 has one end protruding from a side of the clutch body 410 and the other end disposed to be adjacent to the transfer gear 420 such that the clutch lever 430 engages or disengages to the transfer gear 420.

The clutch 400 rotates only the washing shaft 510 in a washing cycle, and rotates both of the spinning shaft 520 and the washing shaft 510 in a spinning cycle.

In the washing cycle, one end of the clutch lever 430 makes contact with the transfer gear 420 to prevent the transfer gear 420 from rotating. Accordingly, the washing shaft 510 rotates but the spinning shaft 520 does not rotate. Accordingly, the pulsator (reference numeral 45 in FIG. 1) connected to the washing shaft 510 rotates but the rotating tub (reference numeral 40 in FIG. 1) connected to the spinning shaft 520 does not rotate.

Meanwhile, in the spinning cycle, the one end of the clutch lever 430 is separated from the transfer gear 420 to allow the transfer gear 420 to rotate. Accordingly, both of the washing shaft 510 and the spinning shaft 520 rotate. Accordingly, the pulsator connected to the washing shaft 510 and the rotating tub connected to the spinning shaft 520 rotate.

Figure 4:
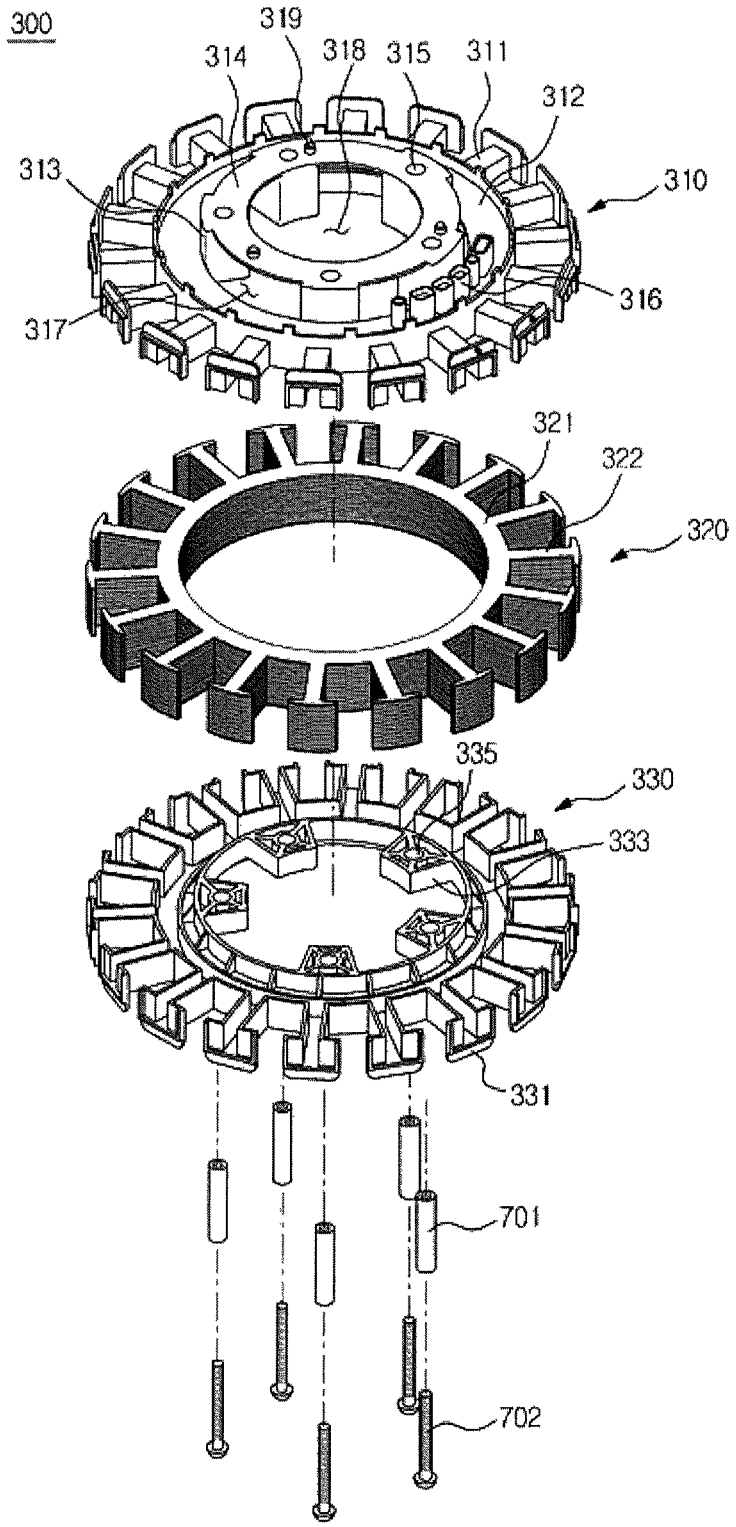
FIG. 4 is a perspective view illustrating the configuration of a stator of the driving apparatus of the washing machine according to the embodiment of the present disclosure.

FIG. 4 is a perspective view illustrating the configuration of a stator of the driving apparatus of the washing machine according to the embodiment of the present disclosure.

The stator 300 includes a stator core 320, an upper insulator 310, and a lower insulator 330.

The stator core 320 includes a base 321, which is provided in the form of a ring, and teeth 322 protruding from the circumference of the base 321 in an outer radial direction of the stator 300.

The upper insulator 310 and the lower insulator 330, including electrically insulated material, are disposed at the upper portion and at the lower portion of the stator core 320, respectively, while covering the stator core 320. When the stator 300 is incorporated into the driving apparatus 10 for the washing machine 1, the lower insulator 330 and the upper insulator 310 are adjacent to the rotor 200 and the clutch 400, respectively.

Each of the upper insulator 310 and the lower insulator 330 has an accommodation part to which the stator core 320 is mounted. Accordingly, as the upper insulator 310 is coupled to the lower insulator 330, the stator core 320 is accommodated in the accommodation part.

A plurality of upper coil support parts 311 protrudes outward from an outer circumference of the upper insulator 310, and a plurality of lower coil support parts 331 protrudes outward from an outer circumference of the lower insulator 310 to correspond to the positions of the upper coil support parts 311.

As the upper insulator 310 is coupled to the lower insulator 330, the upper coil support part 311 forms a unitary body in cooperation with the lower coil support part 331 and the coil (340, in FIG. 3) is wound around the unitary body formed by the coil support parts 311 and 331.

The upper insulator 310 includes a base cover 312 and the upper coil support part 311. The base cover 312 is provided in the shape of a ring corresponding to the shape of the base 321 of the stator core 320 to cover the base 321.

A plurality of support ribs 313 protrude upward from the upper side of the base cover 312 and are arranged along the circumferential direction of the base cover 312. Each of the plurality of support ribs 313 is provided in a hollow structure having a first coupling hole 315 formed therein. According to this embodiment, the number of the support ribs 313 is five, but the present disclosure is not limited thereto. Alternatively, the support ribs 313 may be provided in a predetermined number which is greater than one.

A mounting surface 314 connecting upper surfaces of the plurality of support ribs 313 to one another is provided in the form of a ring. When the clutch (reference number 400 in FIG. 3) is coupled to the stator 300, the clutch is mounted on the mounting surface 314.

A plurality of position-determining protrusions 319 are formed on the mounting surface 314 while being arranged along the circumferential direction of the mounting surface 314.

An opening 318 is formed at an inner radial side of the plurality of support ribs 313. As the clutch 400 is coupled to the stator 300, the transfer gear 420, and the lower protrusion 415 pass through the opening 318 and then disposed inside the stator 300.

The plurality of lower coil support parts 331 protrude outward from the outer side of the lower insulator 310 while being arranged in the circumferential direction of the lower insulator 310.

A plurality of protruding ribs 333 protrudes from the inner side of the lower insulator 330 while being arranged in the circumferential direction of the lower insulator 310. The plurality of protruding ribs 333 is provided at positions each corresponding to the plurality of support ribs 313 in a predetermined number corresponding to the number of the plurality of support ribs. Each of the protruding ribs 333 is provided in a hollow structure having a second coupling hole 335 formed therein.

A connection part 316 is formed on one side of the base cover 312 such that the hall sensor assembly (reference numeral 600 in FIG. 3) is connected to the connection part 316.

The upper insulator 310 is provided in a shape corresponding to that of the lower insulator 330 such that the stator 320 is accommodated by coupling the upper insulator 310 to the lower insulator 330.

If the upper insulator 310 is coupled to the lower insulator 330, the upper coil support part 311 is coupled to the lower coil support part 331 while making contact with each other, thereby forming one coil support part around which the coil 340 is wound.

The upper insulator 310 may be coupled to the lower insulator 330 by use of an additional coupling member. Meanwhile, even if a coupling member is not used, as the upper coil support part 311 and the lower coil support part 331 are wound by the coil 340, the coupling between the upper insulator 310 and the lower insulator 330 is reinforced.

If the upper insulator 310 is coupled to the lower insulator 330, a lower portion of the support rib 313 makes contact with the protruding rib 333, thereby forming a coupling hole that passes through the first coupling hole 315 of the support rib 313 and the second coupling hole 334 of the protruding rib 333.

A sleeve 701 is inserted into the first coupling hole 315 and the second coupling hole 335 to increase the strength of the upper insulator 310 and the lower insulator 330, thereby preventing the breakdown.

Hereinafter, the coupling structure between the clutch 400 and the stator 300 will be described with reference to FIGS. 2 to 4.

As described above, the stator 300 is assembled by coupling the upper insulator 310, the lower insulator 330 and the state core 320 to one another and then winding the coil 340.

The sleeve 701 is inserted into the second coupling hole 335 and the first coupling hole 315 of the stator 300.

When the lower plate 413 of the clutch 400 makes contact with the mounting surface 314 of the stator 300, the position-determining protrusion 319 enables the clutch 400 to be mounted at an adequate position. The lower plate 413 of the clutch 400 has a position-determining hole (not shown) into which the position-determining protrusion 319 is inserted. Accordingly, it is determined that clutch 400 is disposed at a desired position if the position-determining protrusion 319 is inserted into the position-determining hole.

If the clutch 400 is mounted on the mounting surface 314, a bolt 702 is inserted upward from the lower portion of the stator 300 to the lower plate 413 of the clutch 400 by passing through the sleeve 701.

Since the lower plate 413 of the clutch 400 has a bolt-coupling hole (not shown) that enables the clutch 400 to be coupled to the stator 300, as one end of the bolt 702 is coupled to the bolt-coupling hole, the clutch 400 completes coupling with the stator 300.

As the lower plate 413 of the clutch 400 is coupled to the mounting surface 314 of the stator 300 while making contact with each other, the transfer gear 420 is disposed inside the stator 300 by passing through the opening 318. In addition, the lower protrusion 415 corresponding to a part of the clutch 400 may be disposed inside the stator 300 depending on the height of the support rib 313.

As described above, as the stator 300 accommodates the transfer gear 420, and furthermore, lower protrusion 415, the size of the driving apparatus 1 for the washing machine 1 is reduced, thereby reducing the overall size of the washing machine 1.

Hereinafter, the coupling structure between the hall sensor assembly and the upper insulator will be described.

Figure 5:
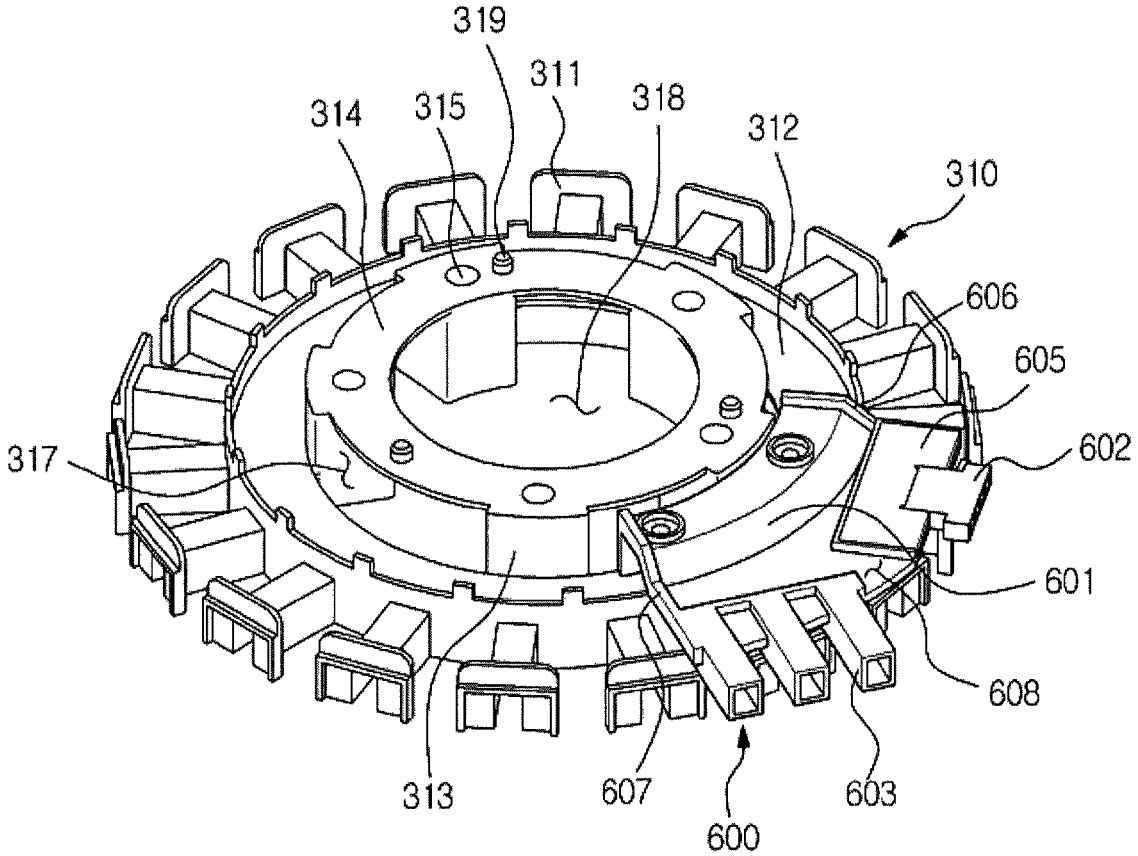
FIG. 5 is a view illustrating a stator coupled to a hall sensor assembly in the driving apparatus of the washing machine according to the embodiment of the present disclosure.

FIG. 5 is a view illustrating a stator coupled to a hall sensor assembly in the driving apparatus of the washing machine according to the embodiment of the present disclosure.

Figure 6:
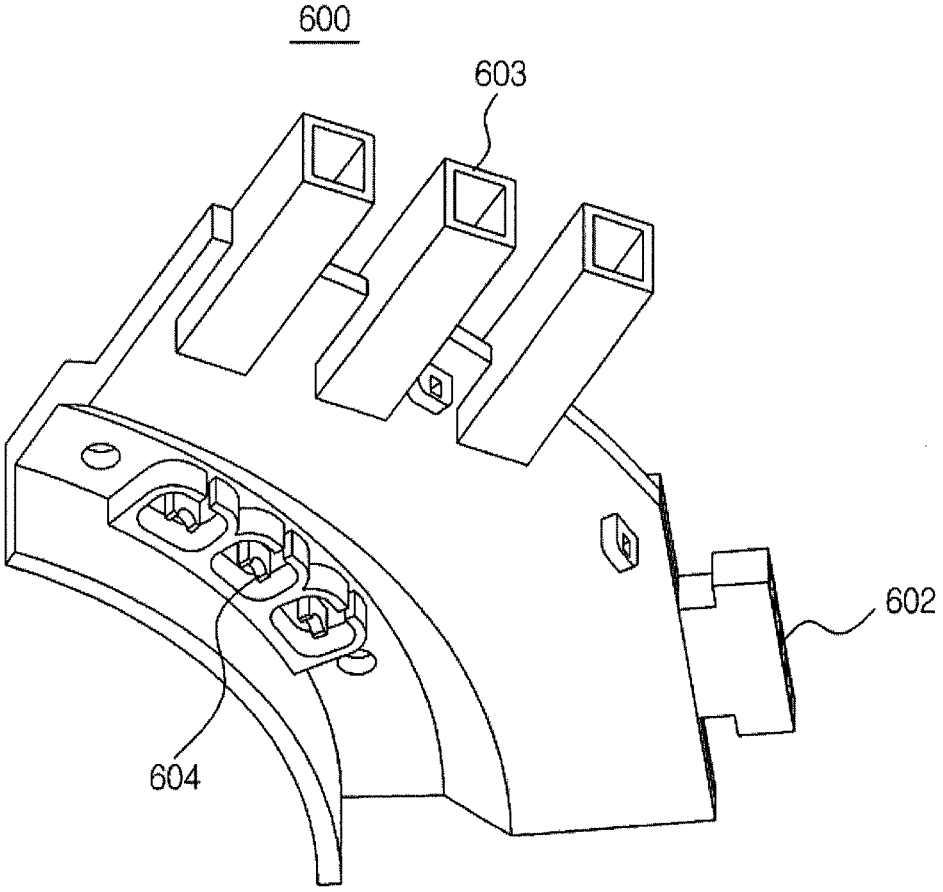
FIGS. 6 and 7 are views illustrating the hall sensor assembly of FIG. 5.
Figure 7:
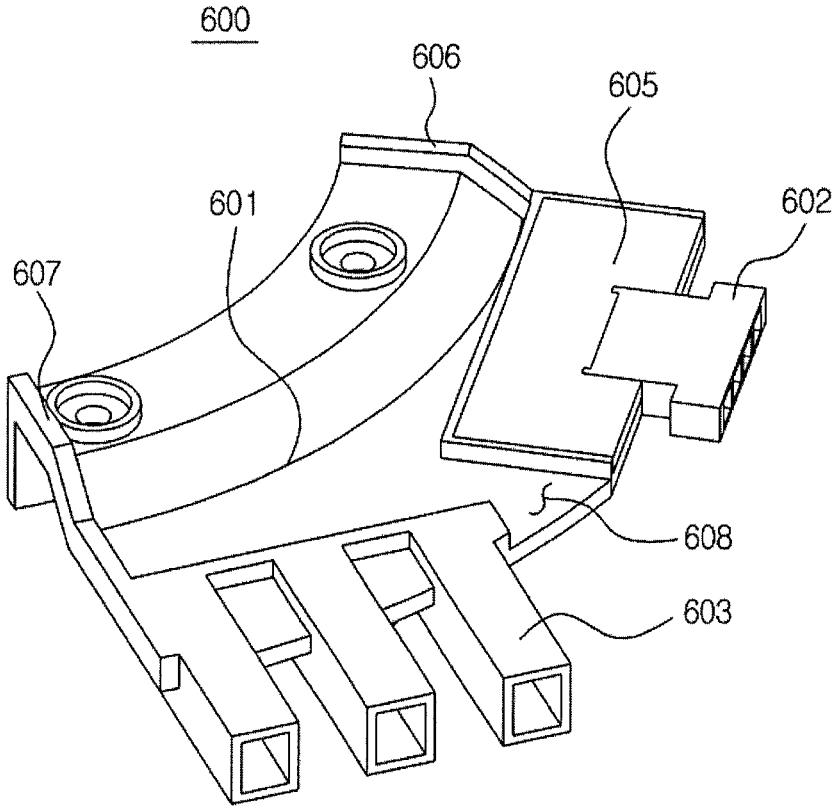

FIGS. 6 and 7 are views illustrating the hall sensor assembly of FIG. 5.

Referring to FIGS. 5, 6 and 7, the hall sensor assembly 600 is connected to the connection part (reference numeral 316 in FIG. 4) provided on the upper surface of the upper insulator 310.

On the hall sensor assembly 600, a power connector 603 and a sensor 605 are disposed at an outer side of radial direction of the motor (100 in FIG. 2). The power connector 603 is configured to supply a power to the motor (reference numeral 100 in FIG. 2). The sensor 605 is configured to detect the magnet (reference numeral 230 in FIG. 3) attached to the rotor 200 such that the rotation of the rotor (reference numeral 200 in FIG. 3) is controlled. A sensing signal detected by the sensor 605 is transmitted to a control part (not shown) through a connector 602 that is coupled to the sensor 605.

The hall sensor assembly 600 is provided at a lower portion thereof with a connection pin 604 that has a shape corresponding to the connection part (reference numeral 316 in FIG. 4) provided on the upper surface of the upper insulator 310. As the connection pin 604 is electrically connected to the connection part 316, a power is supplied to the motor (reference numeral 100 in FIG. 2) through the power connector 603.

An upper surface 601 of the hall sensor assembly 600 is implemented as a slanting surface that lowers with a slope in an outward radial direction of the stator 300.

Side walls 606 and 607 extend from the upper surface 601 to prevent water from flowing sideways. The sensor 605 and the power connector 603 protrude upward from a radial outer side of the stator 300 of the upper surface 601 such that the sensor 605 and the power connector 603 are provided at positions higher than that of the upper surface 601. Accordingly, the side walls 606 and 607, the sensor 605 and the power connector 603 form a passage that allows water to flow through a discharge part 608.

Accordingly, even if water leaking from the tub (reference numeral 20 in FIG. 1) is fallen on the sensor 605, the water is drained through the discharge part 608 along the slanting surface without flowing sideways, thereby preventing water from being infiltrated into the sensor 606, the coil (reference numeral 340 in FIG. 3) and the connection part (reference numeral 316 FIG. 4).

Meanwhile, in order to prevent water from being infiltrated into the connection part (reference numeral 316 in FIG. 4), the hall sensor assembly 600 is provided to have a size larger than that of the connection part 316.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A driving apparatus for a washing machine which comprises a rotatable tub to accommodate laundry and a pulsator rotatably installed at a lower portion of the rotating tub to generate a stream of water and move the laundry, the driving apparatus comprising:

a stator provided in a shape of a ring;

a rotor disposed around the stator and rotating by electromagnetic interaction with the stator; and a clutch configured to transmit a driving force of the rotor selectively to a spinning shaft, wherein the clutch comprises a clutch body to accommodate a portion of a driving shaft therein, the clutch body being disposed between the rotatable tub and the stator, wherein the stator comprises a stator core and an insulator disposed between the stator core and a coil, and wherein the clutch includes a transfer gear that is disposed inside the stator.

2. The driving apparatus of claim 1, wherein the insulator includes a mounting part protruding toward the clutch body such that the stator core is spaced apart from a lower surface of the clutch body in an axial direction of the driving shaft while the clutch body is coupled to the mounting part of the insulator, and wherein the mounting part comprises a mounting surface contacting with the lower surface of the clutch body.

3. The driving apparatus of claim 2, wherein the transfer gear of the clutch is provided at a lower portion of the clutch body to selectively transmit the driving force to the rotating tub, and wherein the insulator further comprises a central opening in which the transfer gear of the clutch is located.

4. The driving apparatus of claim 3, wherein the clutch further comprises a clutch lever one end of which is located in the central opening of the insulator and another end of which is located at a side of the clutch body.

5. The driving apparatus of claim 2, wherein the mounting part comprises a coupling hole passing through the mounting part in the axial direction.

6. The driving apparatus of claim 5, wherein the mounting part further comprises a position-determining protrusion formed on the mounting surface such that the clutch body is coupled to a precise position of the mounting surface.

7. The driving apparatus of claim 1, wherein the insulator comprises, a lower insulator disposed at one side of the stator core, and an upper insulator coupled to the lower insulator, the upper insulator being disposed closer to the clutch body than the lower insulator, and wherein the mounting part is formed integrally with the upper insulator.

8. The driving apparatus of claim 7, further comprising a hall sensor disposed on the upper insulator to sense a magnet provided on the rotor.

9. The driving apparatus of claim 8, wherein the upper insulator is provided with a connection part to which the hall sensor is connected.

10. A washing machine comprising:

a rotating tub configured to accommodate laundry;

a pulsator disposed inside the rotating tub;

a stator disposed at a lower portion of the rotating tub a rotor disposed to make an electromagnetic interaction with the stator; and a clutch, which is configured to transmit a rotary force of the rotor selectively to the rotating tub and the pulsator and comprises a clutch body and a transfer gear disposed at a lower portion of the clutch body, wherein the stator comprises:

a stator core, a lower insulator covering a lower portion of the stator core, and an upper insulator covering an upper portion of the stator core and comprising a plurality of support ribs, which are arranged along a circumferential direction of the stator and coupled to the clutch body, and an opening that allows the transfer gear to pass therethrough when the stator is coupled to the clutch, and wherein the transfer gear of the clutch is disposed inside the stator.

11. The washing machine of claim 10, wherein the plurality of support ribs protrudes upward from an upper side of the upper insulator.

12. The washing machine of claim 11, wherein the plurality of support ribs are spaced apart from one another, and wherein the clutch further comprises a clutch lever that extends to be adjacent to the transfer gear by passing through between the support ribs.

13. The washing machine of claim 10, further comprising a hall sensor assembly coupled to an upper portion of the stator and comprising a upper surface having a slanting surface that lowers with a slope in an outward radial direction of the stator such that water flows in an opposite direction of a central shaft of the clutch.

14. The driving apparatus of claim 1, further comprising:

a driving shaft having a spinning shaft connected to the rotatable tub and a washing shaft connected to the pulsator, wherein the stator further comprises the coil wound around the stator core, and wherein the insulator has a mounting part protruding toward the clutch body such that the stator core is spaced apart from a lower surface of the clutch body in an axial direction of the driving shaft while the clutch body is coupled to the mounting part of the insulator.

* * * * *